US005185240A

United States Patent [19]

Miyata et al.

[11] Patent Number: 5,185,240

[45] Date of Patent: Feb. 9, 1993

[54] SILVER HALIDE PHOTOGRAPHIC MATERIAL

[75] Inventors: Junji Miyata; Satoshi Kanetake; Yasufumi Morimoto; Kenji Hanayama, all of Kanagawa, Japan

[73] Assignee: Fuji Photo Film Co., Ltd., Kanagawa, Japan

[21] Appl. No.: 565,083

[22] Filed: Aug. 10, 1990

[30] Foreign Application Priority Data

| | | | |
|---|---|---|---|
| Aug. 11, 1989 | [JP] | Japan | 1-209317 |
| Sep. 14, 1989 | [JP] | Japan | 1-239279 |
| Sep. 26, 1989 | [JP] | Japan | 1-250006 |

[51] Int. Cl.[5] ..... G03C 1/485; G03C 1/34

[52] U.S. Cl. ..... 430/596; 430/569; 430/597; 430/598; 430/607; 430/614; 430/940

[58] Field of Search ..... 430/607, 614, 596, 597, 430/569, 940, 598, 411, 412

[56] References Cited

U.S. PATENT DOCUMENTS

| | | | |
|---|---|---|---|
| 2,870,015 | 1/1959 | Allen et al. | 430/614 |
| 3,501,307 | 3/1970 | Illingsworth | 430/569 |
| 3,526,507 | 9/1970 | Ishikawa et al. | 430/596 |
| 3,650,759 | 3/1972 | Sonoda et al. | 430/607 |
| 4,059,450 | 11/1977 | Vanassche et al. | 430/569 |
| 4,923,790 | 5/1990 | Kato et al. | 430/523 |
| 4,997,752 | 3/1991 | Sasaki et al. | 430/611 |
| 5,059,516 | 10/1991 | Sato et al. | 430/607 |

*Primary Examiner*—Marion E. McCamish
*Assistant Examiner*—Janis L. Dote
*Attorney, Agent, or Firm*—Sughrue, Mion, Zinn, Macpeak & Seas

[57] ABSTRACT

Disclosed is an autopositive silver halide photographic material which comprises at least one silver halide emulsion layer, characterized in that said emulsion layer or at least one other hydrophilic colloid layers contains at least one compound selected from the group consisting of compounds represented by the following general formulas (1), (2) and (3):

(1)

wherein $R_1$ represents hydrogen atom or an alkyl group; and $R_2$, $R_3$ and $R_4$ each represents hydrogen atom, a halogen atom, an alkyl group or an alkoxy group;

(2)

wherein $R_5$ represents hydrogen atom or an alkyl group; and $R_6$ and $R_7$ each represents hydrogen atom, an alkyl group, a halogen atom or an aryl group;

(3)

wherein $R_8$ represents a lower alkylene group; X represents a halogen atom, nitro group, hydroxy group, a cyano group, a lower alkyl group, a lower alkoxy group, or $-SO_3M$; $R_{12}$ represents hydrogen atom, —OM, a lower alkyl group, a lower alkoxy group or $R_{13}$ and $R_{14}$ may be the same or different groups and each represents hydrogen atom, a lower alkyl group, $-COR_{17}$ or $-SO_2R_{17}$; $R_{15}$ and $R_{16}$ may be the same or different groups and each represents hydrogen atom or a lower alkyl group; $R_{17}$ represents a lower alkyl group; M represents hydrogen atom, an alkali metal or an atomic group required for forming a monovalent cation; and n represents 0 or an integer of 1 to 5.

8 Claims, No Drawings

SILVER HALIDE PHOTOGRAPHIC MATERIAL

FIELD OF THE INVENTION

This invention relates to an autopositive silver halide photographic material. It also relates to a process for preparing a silver halide photographic material which gives a direct positive image.

BACKGROUND OF THE INVENTION

Silver halide photographic materials are roughly classified into two types, that is, (1) a type of photographic material which gives a negative image of the original after exposure and development and (2) a type of photographic material which gives a positive image of the original after exposure and development. The present invention relates to the latter type. Silver halide photographic materials which give direct positive image have been well known for many years [see, JP-B-43-13488 (the term "JP-B" as used herein means an "examined Japanese patent publication") and U.S. Pat. No. 3,501,305]. However, silver halide photographic materials which give direct positive image have a problem in that they are sensitized when stored in air after preparation.

Further, there is the problem that they are sensitized during storage until coated photographic materials are made after the preparation of fogged emulsions in the manufacturing process of silver halide photographic materials.

For example, it has been conventional to lower the temperature during the storage of emulsions (for example, emulsions are stored at 5° to 10° C.) to limit any change in sensitivity. However, a change in sensitivity could not be sufficiently limited. Further, a change in sensitivity is apt to be limited when the pH of the emulsions is raised. However, a change in sensitivity cannot be satisfactorily limited by raising the pH either.

Sensitization with the passage of time is larger, the higher the sensitivity of the emulsion used (density is less with lower light).

SUMMARY OF THE INVENTION

An object of the present invention is to provide a silver halide photographic material which gives a direct positive image and scarcely changes in sensitivity during storage in air after the preparation thereof.

Another object of the present invention is to provide a process for preparing a silver halide photographic material which gives a direct positive image and, which process scarcely allows a change in sensitivity during the storage of emulsion before the coated photographic material is made but after the preparation of a fogged emulsion in the manufacturing process of the silver halide photographic material.

The first object of the present invention has been achieved by an autopositive silver halide photographic material which has at least one silver halide emulsion layer, characterized in that the emulsion layer or at least one other hydrophilic colloid layer contains at least one compound selected from the group consisting of compounds represented by the following general formulas (1), (2) and (3).

The second object of the present invention has been achieved by a method for preparing an autopositive silver halide photographic material comprising the step of adding at least one compound selected from the group consisting of compounds represented by the following general formulas (1), (2) and (3) to a silver halide photographic emulsion.

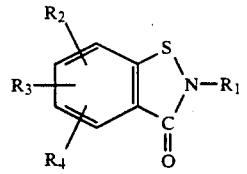

(1)

In formula (1), $R_1$ represents hydrogen atom or an alkyl group preferably having 1 to 18 carbon atoms, more preferably 1 to 6 carbon atoms; and $R_2$, $R_3$ and $R_4$ each represents hydrogen atom, a halogen atom, an alkyl group, preferably having 1 to 3 carbon atoms or an alkoxy group, preferably having 1 to 3 carbon atoms or two of $R_2$, $R_3$ and $R_4$ may form a ring.

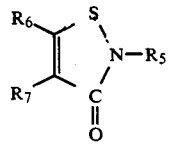

(2)

In formula (2), $R_5$ represents hydrogen atom or an alkyl group preferably having from 1 to 3 carbon atoms; and $R_6$ and $R_7$ each represents hydrogen atom, an alkyl group preferably having from 1 to 3 carbon atoms, a halogen atom or an aryl group or may form a ring together.

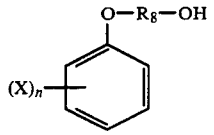

(3)

In formula (3), $R_8$ represents a lower alkylene group preferably having from 1 to 4 carbon atoms; X represents a halogen atom, nitro group, hydroxy group, cyano group, a lower alkyl group preferably having from 1 to 3 carbon atoms, a lower alkoxy group preferably having from 1 to 3 carbon atoms, $-COR_{12}$,

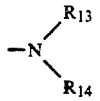

or $-SO_3M$; $R_{12}$ represents hydrogen atom, —OM, a lower alkyl group, a lower alkoxy group or

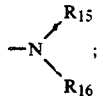

$R_{13}$ and $R_{14}$ may be the same or different groups and each represents hydrogen atom, a lower alkyl group, $-COR_{17}$ or $-SO_2R_{17}$; $R_{15}$ and $R_{16}$ may be the same or different groups and each represents hydrogen atom or a lower alkyl group; $R_{17}$ represents a lower alkyl group; M represents hydrogen atom, an alkali metal or an atomic group required for forming a monovalent cation; and n represents 0 or an integer of 1 to 5.

DETAILED DESCRIPTION OF THE INVENTION

The present invention is described in more detail below.

Examples of the compounds represented by general formula (1) include, but are not limited to, the following compounds:

(i)

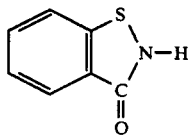

(ii)

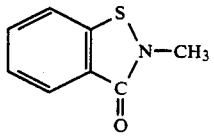

(iii)

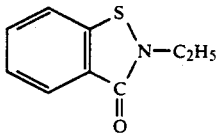

(iv)

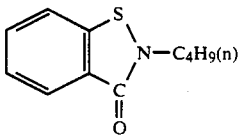

(v)

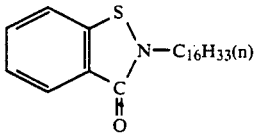

(vi)

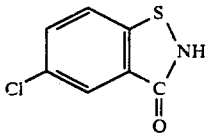

(vii)

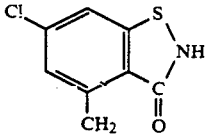

(viii)

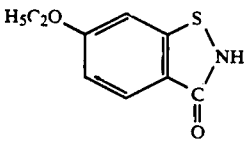

Examples of the compounds represented by general formula (2) include, but are not limited to, the following compounds:

(ix)

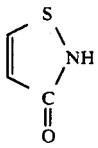

(x)

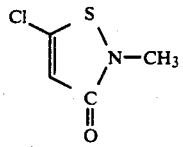

(xi)

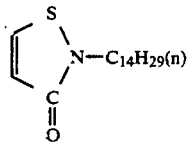

(xii)

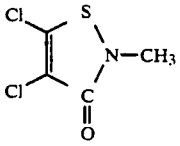

(xiii)

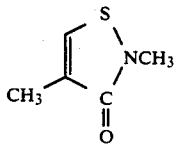

(xiv)

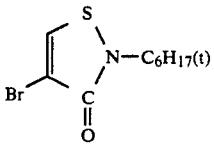

Examples of the compounds represented by general formula (3) include, but are not limited to, the following compounds:

(xv)

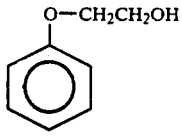

(xvi)

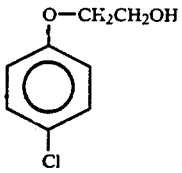

(xvii)

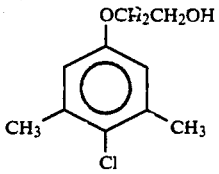

-continued
(xviii)
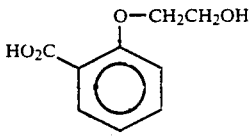
(xix)
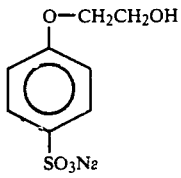
(xx)
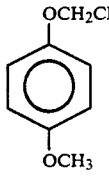
(xxi)
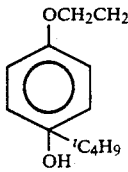
(xxii)
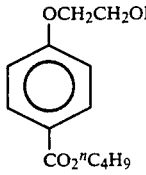
(xxiii)
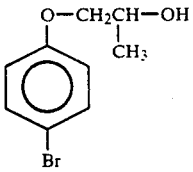
(xxiv)
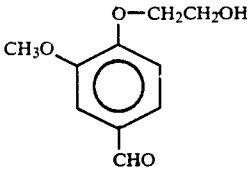
(xxv)
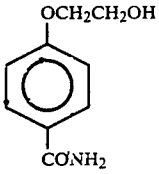
(xxvi)
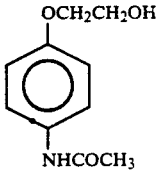
-continued
(xxvii)
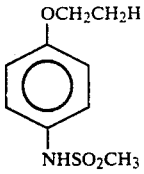
(xxviii)
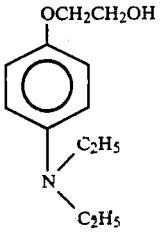
(xxix)
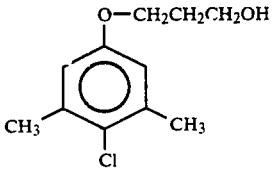
(xxx)
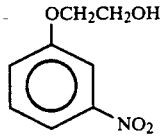
(xxxi)
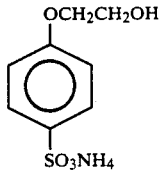
(xxxii)
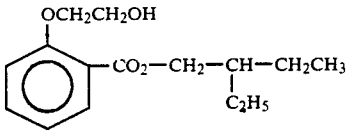
(xxxiii)
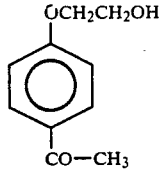
(xxxiv)
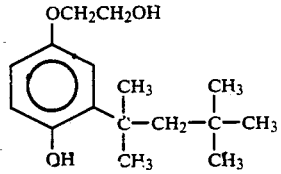
(xxxv)
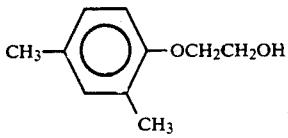

-continued (xxxvi)

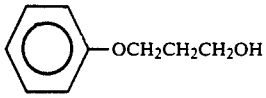

(xxxvii)

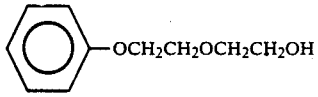

(xxxviii)

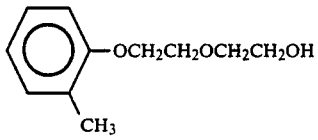

(xxxix)

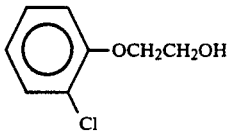

(xL)

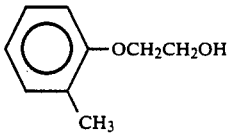

(xLi)

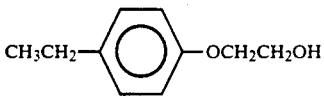

(xLii)

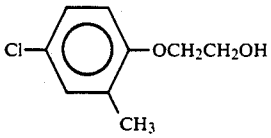

(xLiii)

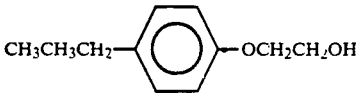

The compounds represented by formulas (1), (2) and (3) are known as preservatives (antiseptics) [see, JP-A-54-27424 and JP-A-59-142543 (the term "JP-A" as used herein means an "unexamined published Japanese patent application")]. Accordingly, it is an unexpected and surprising finding that these compounds have the above-described effect on silver halide photographic materials which give direct positive image.

The above compounds of the present invention can be synthesized according to the method described in Rindfusx, *J. Am. Chem. Soc.*, Vol. 41, p. 669 (1919).

The compounds of formulas (1) and (2) according to the present invention are used in an amount of preferably $5\times10^{-6}$ to $5\times10^{-3}$ mol per mol of silver, though there is no particular limitation with regard to the amounts of the compounds of formulas (1) and (2) to be incorporated in the photographic material.

The compounds of formula (3) according to the present invention are used in an amount of preferably $2\times10^{-6}$ to $2\times10^{-1}$ mol, particularly preferably $2\times10^{-3}$ to $10^{-2}$ mol per mol of silver halide.

The compounds of formulas (1) and (2) can be incorporated in the photographic material by adding them in the form of an aqueous solution when the compounds are water-soluble, or in the form of a solution thereof in a water-miscible organic solvent such as an alcohol (e.g., methanol, ethanol), an ester, (e.g., ethyl-acetate) or a ketone (e.g., acetone) when the compounds are water-insoluble. When a use of an organic solvent is undesirable, a use of an aqueous solution having a high pH value (e.g., 8.0 or more) is preferable, because such a solution provides a higher solubility of the compounds. The compounds may be dissolved in a mixture of an organic solvent and water.

The compounds of formula (3) can be incorporated in the photographic material by adding them in the form of an aqueous solution to a silver halide solution or a hydrophilic colloid solution for a layer adjacent the silver halide layer when the compounds are water-soluble. Alternatively, the compounds are added in the form of a solution thereof in a water-miscible organic solvent such as an alcohol (e.g., methanol, ethanol), an ester (e.g., ethyl acetate) or a ketone (e.g., acetone) when the compounds are water-insoluble.

As stated above, an object of the present invention is to reduce a change in sensitivity during storage in air after the preparation of the photographic material. To achieve the object, the compound of formula (1), (2) or (3) may be added at any stage.

Object of the present invention is to reduce a change in sensitivity during the storage of a fogged emulsion for use in the photographic material which gives direct positive image. To achieve this object, a compound of formula (1), (2) or (3) must be incorporated in the emulsion to be stored. The compound must be added during any one of the manufacturing stages of the emulsion to be stored. Preferably, the compound is added before the emulsion is stored, but after the completion of the fogging stage of the emulsion.

There is no particular limitation with regard to the sensitivity of direct positive emulsion used in the present invention. However, it is preferred to use a direct positive emulsion having the characteristics (1) that the density is at least 2.0 when a sample is prepared by coating the emulsion in such an amount as to give a coating weight of 3.0 g/m$^2$ (in terms of silver) and unexposed sample is developed, and (2) that the density is not higher than 1.8 when the sample is exposed to a tungsten light source (color temperature: 2854K.) for (357) lux (100) seconds and developed. The measurement of the density described above is carried out under the development conditions of using the following developing solution at 38° C. for 20 seconds.

(a) Composition of developing solution:

| | |
|---|---|
| Phenidone | 0.8 g |
| Hydroquinone | 25 g |
| Potassium bromide | 3.3 g |
| Sodium carbonate | 10.8 g |
| Potassium sulfite | 67 g |
| 5-Methylbenztriazole | 0.2 g |
| Ethylenediaminetetraacetic acid | 2.8 g |
| Sodium 2-mercaptobenzimidazole-5-sulfonate | 0.3 g |
| Add KOH and $H_2O$ | to make 1 liter; and pH 10.7 |

In the case of the present invention, emulsions having high sensitivity inhibit sensitization with the passage of time before coating but after the preparation of the emulsions and inhibit the sensitization of samples with the passage of time in air after coating.

Silver halide having any composition can be used in the present invention. However, silver bromide, silver iodobromide, silver chlorobromide and silver chlorobromoiodide are preferred.

Grain size of the silver halide is 0.05 to 1.0μ, preferably 0.1 to 0.4μ.

Silver halide grains in the photographic emulsion of the present invention may have regular crystal form such as cube or octahedron or irregular crystal form such as sphere or tabular form.

It is preferred that grain size distribution is narrow. It is particularly preferred that grains having a grain size of the mean grain size ±40% account for at lest 90%, preferably 95% of all grains. Namely, monodisperse emulsions are preferred.

Emulsions used in the direct positive type silver halide photographic material of the present invention are classified into two types. The first is an emulsion which has a nucleus capable of trapping free electrons in the interior of silver halide and comprises silver halide grains whose surfaces are previously fogged. A feature of the emulsion of this type is that the emulsion itself gives directly positive image. When sensitizing dyes are added thereto, a spectral sensitizing effect can be imparted thereto and high sensitivity as well as sensitization in an inherent absorption region can be imparted. Metal salts of the Group VIII elements are preferred as the free electron trapping nuclei of the emulsions of this type.

The other type is an emulsion which does not have a free electron trapping nucleus in the interior of silver halide and comprises silver halide grains whose surfaces are chemically fogged. The emulsion itself gives no direct positive image, but the emulsion gives direct positive image by desensitizers.

Examples of appropriate emulsions having an electron trapping nucleus include those described in JP-B-43-4125, JP-B-43-29405, U.S. Pat. Nos. 2,401,051, 2,976,149 and 3,023,102, U.K. Patents 707,704 and 1,097,999, French Patents 1,520,824 and 1,520,817 and Belgian Patents 713,272, 721,567 and 681,768.

Examples of appropriate emulsions which have no electron trapping nucleus include those described in U.K. Patents 1,186,717, 1,186,714 and 1,186,716, U.S. Pat. Nos. 3,501,306, 3,501,307, 3,501,310, 3,531,288 and 1,520,817.

The internal electron acceptor can be incorporated in the silver halide grains of the present invention by adding an aqueous solution of a water-soluble noble metal compound such as a chloride of a Group VIII metal such as iridium or rhodium in an amount of $10^{-7}$ to $10^{-3}$ mol, preferably $10^{-5}$ to $10^{-3}$ mol per mol of silver halide during the preparation of silver halide grains.

The autopositive photographic silver halide emulsions of the present invention can be fogged by conventional methods such as by light or chemical treatment. Such fogging can be achieved, for example, by carrying out chemical sensitization until fogging is caused. For example, particularly good results can be obtained by the methods described in *Science and Industry Photography* 28, January 1957, pp. 57-65. According to those methods, silver halide grains are fogged by intensive light, reducing fogging agents such as thiourea dioxide and stannous chloride or gold or noble metal compounds. A combination of a reducing agent with a gold compound or a compound of a metal which is electrically more positive than silver such as a compound of rhodium, platinum or iridium, can be used to fog silver halide grains.

In the direct positive type photographic emulsions of the present invention, silver halide grains may be subjected to reduction fogging and gold fogging. Silver halide grains fogged by both the reducing a fogging agent and a gold fogging agent are preferred from the viewpoints of imparting high sensitivity and reducing Dmin. When a reduction fogging agent and a gold fogging agent are used at a low concentration in combination, fogged silver halide grains can be obtained having the unique property that fog is rapidly lost by chemical bleaching. It is known that one equivalent of silver halide is reduced to silver by one equivalent of a reducing agent. The reducing fogging agent in an amount of considerably less than one equivalent is used to obtain fogged silver halide grains in which fog may be rapidly lost by bleaching. Namely, the reducing fogging agent is used in an amount of not more than about 0.06 milliequivalents per mol of silver halide to fog silver halide grains. In the practice of the present invention, the reducing fogging agent is used in an amount of generally about 0.0005 to about 0.06 milliequivalents, preferably about 0.001 to about 0.03 milliequivalents per mol of silver halide to fog silver halide grains. When the concentration of the reducing agent is increased, photographic speed suffers a heavy loss. Examples of the reducing fogging agents which can be used in the present invention include hydrazine, phosphonium salts such as tetra(hydroxymethyl)phosphonium chloride and thiourea dioxide (described in U.S. Pat. Nos. 3,062,651 and 2,983,609); stannous salts such as stannous chloride (see U.S. Pat. No. 2,487,850); polyamines such as diethylenetriamine (see U.S. Pat. No. 2,519,698); polyamines such as suberylamine (see U.S. Pat. No. 2,521,925); and bis(β-aminoethyl)sulfide and water-soluble salts thereof (see U.S. Pat. No. 2,521,916) and aminoiminomethanesulfinic acid.

Examples of the gold fogging agents which can be used in the present invention include gold salts which are used for fogging photographic silver halide grains and described in U.S. Pat. Nos. 2,399,083 and 2,642,361. More specifically, examples of the gold fogging agents include potassium chloroaurite, potassium aurithiocyanate, potassium chloroaurate. auric trichloride and aurosulfobenzthiazole methochloride. The concentrations of the gold fogging agents which are used in the present invention can be widely varied, but are generally in the range of 0.001 to 0.01 mmol per mol of silver halide. Potassium chloroaurate is a preferred gold fogging agent and is used at a concentration of not higher than about 5 mg, preferably 0.5 to 4 mg per mol of silver halide. When the gold fogging agent is used in combination with the reducing fogging agent, it is preferred that the principal ingredient of the combination is the gold fogging agent. The ratio of the gold fogging agent to the reducing fogging agent is generally about 1:3 to about 20:1, but the ratio is often about 2:1 to 20:1. It is preferred that silver halide grains are fogged with the reducing fogging agent and then with the gold fogging agent. However, they may be used in the reverse order. If desired, the reducing fogging agent and the gold fogging agent may be used simultaneously.

Generally, the degree of fogging is such that a density of at least 2.0 is given when developed with developing solutions.

Further, appropriate fogging methods are described in U.S. Pat. Nos. 3,501,305, 2,717,833, 3,367,778, 2,401,051 and 3,023,102, U.K. Patents 723,019, 707,704 and 1,097,999, French Patents 1,498,213, 1,513,428, 1,518,095, 1,520,822, 1,520,824, 1,518,094, 1,513,840 and 739,755 and Belgian Patents 713,272, 721,567 and 708,563, JP-B-43-4125 and JP-B-43-13488.

When silver halide grains are fogged, reaction conditions can be widely varied. Generally, pH is about 5 to 7, pAg is about 7 to 9 and the temperature is about 40° to 100° C., usually about 50° to 70° C.

Examples of organic desensitizers or desensitizing dyes which can be used in the present invention include: nitrostyryl type compounds, pinakryptol yellow and 5-meta nitrobenzylidenerhodanine described in U.S. Pat. No. 2,669,515; bis-pyridinium compounds described in JP-B-48-13059; phenazine compounds described in JP-B-47-8746; desensitizing dyes described in JP-B-47-9307, JP-B-47-9308, JP-B-48-24046 and JP-B-58-1768; and organic desensitizers described in JP-A-63-75738 and JP-A-63-75739. Additionally, the desensitizers and desensitizing dyes described in the following publications are also used in the present invention; U.S. Pat. Nos. 2,717,833, 2,497,875, 2,323,187, 2,497,876, 3,314,796, 3,364,026, 2,901,351, 3,023,102, 3,062,651 and 3,367,779, U.K. Patents 723,019, 1,078,682, 667,206, 698,575, 698,576, 748,681, 796,873, 834,839, 871,938, 873,937, 875,887, 905,237, 907,367 and 940,152, French Patents 1,498,213, 1,518,095, 1,520,817, 1,520,821, 1,522,355, 1,513,841, 1,522,354, 1,520,818, 1,520,824, 1,518,094, 1,513,840, 1,520,819, 1,520,823, 1,522,626, 1,546,266 and 1,514,857, Belgian Patents 695,367, 719,182, 720,437, 721,964, 722,457, 722,594, 722,593 and 724,739, JP-B-26-7270, JP-B-43-4125, JP-B-38-22326 and JP-B-43-13617.

Particularly preferred examples of the desensitizers are 2-(1,3-dinitrophenylthio)benzimidazole and derivatives thereof, 2-(1,3-dinitrophenylthio)benztriazole and derivatives thereof and 5-nitrobenzimidazole and derivatives thereof.

Particularly preferred examples of the desensitizing dyes are pyrazolo(1,5a-benzimidazole) compounds described in JP-B-57-21886 and pyrazolo(5,16-quinazolone) compounds described in JP-A-49-29828.

The amounts of the above-described organic desensitizers or desensitizing dyes to be added are preferably $1\times10^{-6}$ to $5\times10^{-1}$ mol, particularly preferably $1\times10^{-5}$ to $2\times10^{-2}$ mol, per mol of silver halide. The organic desensitizers or the desensitizing dyes can be incorporated in the photographic material, for example, by adding the compounds in the form of an aqueous solution to the solution of the silver halide emulsion or the hydrophilic colloid solution for a layer adjacent the silver halide emulsion layer when the compounds are water-soluble. Alternatively, a solution of the desensitizer or the dye in a water-miscible organic solvent such as an alcohol (e.g., methanol, ethanol), an ester (e.g., ethyl acetate) or a ketone (e.g., acetone) is added when the compounds are water-insoluble.

When the desensitizer or the desensitizing dye is added to the solutions of silver halide emulsion, the addition may be made at any stage after the commencement of chemical ripening. However, it is preferred that the addition be made after the completion of chemical ripening. It is particularly preferred that the desensitizer or the desensitizing dye is added to a coating solution prepared for coating.

The photographic material of the present invention may contain various compounds to prevent fogging from being caused during the preparation or storage of the photographic material or during the processing thereof or to stabilize photographic performance. Examples of such compounds, which are known as antifogging agents or stabilizers, include azoles such as benzthiazolium salts, nitroindazoles, chlorobenzimidazoles, bromobenzimidazoles, mercaptothiazoles, mercaptobenzthiazoles, mercaptothiadiazoles, aminotriazoles, benzthiazoles and nitrobenztriazoles; mercaptopyrimidines; mercaptotriazines; thio-keto compounds such as oxazolinethione; azaindenes such as triazaindenes, tetraazaindenes (particularly 4-hydroxy-substituted (1,3,3a,7)tetraazaindenes) and pentaazaindenes; and benzenethiosulfonic acid, benzenesulfinic acid and benzenesulfonamide. Among them, benztriazoles (e.g., 5-methylbenztriazole) and nitroindazoles (e.g., 5-nitroindazole) are preferred. These compounds may be added to processing solutions.

The photographic emulsions and other hydrophilic colloid layers of the photographic material of the present invention may contain inorganic or organic hardening agents.

Examples of the hardening agents include chromium salts (e.g., chromium alum, chromium acetate), aldehydes (e.g., formaldehyde, glyoxal, glutaraldehyde), N-methylol compounds (e.g., dimethylol urea, methylol dimethylhydantoin), dioxane derivatives (e.g., 2,3-dihydroxydioxane), active vinyl compounds (e.g., 1,3,5-triacryloyl-hexahydro-s-triazine, 1,3-vinylsulfonyl-2-propanol), active halogen compounds (e.g., 2,4-dichloro-6-hydroxy-s-triazine) and mucohalogenic acids (e.g., mucochloric acid, mucophenoxychloric acid). These compounds may be used either alone or in combination.

The photographic emulsion layers or other hydrophilic colloid layers of the photographic material of the present invention may contain various surfactants as coating aids or for the purpose of imparting antistatic properties, improving slipperiness, emulsifying dispersions or improving photographic characteristics (e.g., development acceleration, high contrast, sensitization) or preventing sticking.

Examples of the surfactants which can be used in the present invention include nonionic surfactants such as saponin (steroid), alkylene oxide derivatives (e.g., polyethylene glycol, polyethylene glycol/polypropylene glycol condensate, polyethylene glycol alkyl ethers, polyethylene glycol alkylaryl ethers, polyethylene glycol esters, polyethylene glycol sorbitan esters, polyalkylene glycol alkylamines or amides, polyethylene oxide adducts of silicone), glycidol derivatives (e.g., polyglyceride of alkenylsuccinic acids, alkylphenol polyglyceride), fatty acid esters of polyhydric alcohols and alkyl esters of saccharose; anionic surfactants having an acid group (e.g., a carboxy group, a sulfo group, a phospho group, a sulfuric ester group, a phosphoric ester group) such as alkylcarboxylates, alkylsulfonates, alkylbenzenesulfonates, alkylnaphthalenesulfonates, alkylsulfuric esters, alkylphosphoric esters, N-acyl-N-alkyltaurines, sulfosuccinic esters, sulfoalkylpolyoxyethylene alkylphenyl ethers and polyoxyethylene alkylphosphoric esters; ampholytic surfactants such as amino acids, aminoalkylsulfonic acids, aminoalkylsulfuric or phosphoric esters, alkylbetaines and amine oxides; and cationic surfactants such as alkylamine salts, aliphatic or aromatic quaternary ammonium salts, heterocyclic quaternary ammonium salts such as pyridinium salts and imidazolium salts and aliphatic or heterocyclic phosphonium or sulfonium salts.

Surfactants which can be preferably used in the present invention are polyalkylene oxides having a molecular weight of not less than 600 described in JP-B-58-9412. Fluorine-containing surfactants are preferred for the purpose of imparting antistatic properties.

Polyalkylene oxide surfactants which may be used in the present invention include the condensates of a polyalkylene oxide composed of at least 10 units of an alkylene oxide having 2 to 4 carbon atoms such as ethylene oxide, propylene-1,2-oxide or butylene-1,2-oxide, preferably ethylene oxide with a compound having at least one active hydrogen atom such as water, an aliphatic alcohol, an aromatic alcohol, a fatty acid, an organic amine or a hexitol derivative; and the block copolymers of two or more such polyalkylene oxides. More specifically, examples of the polyalkylene oxide compounds include polyalkylene glycols, polyalkylene glycol alkyl ethers, polyalkylene glycol aryl ethers, polyalkylene glycol alkyl aryl ethers, polyalkylene glycol esters, polyalkylene glycol fatty acid amides, polyalkylene glycol amines, polyalkylene glycol block copolymers and polyalkylene glycol graft polymers. The polyalkylene oxide compounds must have a molecular weight of not less than 600.

The number of polyalkylene oxide chains per molecule may be one or more. Individual polyalkylene oxide chain may be composed of less than 10 alkylene oxide units, but the sum total of alkylene oxide units in the molecule must be at least 10. When two or more polyalkylene oxide chains exist in the molecule, the chains maybe different alkylene oxide units, for example, the chains may be composed of ethylene oxide and propylene oxide. The polyalkylene oxide compounds which are used in the present invention have preferably 14 to 100 alkylene oxide units and are described in JP-A-50-156423, JP-A-52-108130, JP-A-53-3217, JP-A-63-75738 and JP-A-63-75739. These polyalkylene oxide compounds may be used either alone or in a combination of two or more of them.

These polyalkylene oxide compounds can be added to the silver halide emulsions by adding them in the form of an aqueous solution or a low-boiling water-miscible organic solvent solution to the emulsion at an appropriate stage before coating, preferably after chemical ripening. These compounds also may be added to non-sensitive hydrophilic colloid layers such as interlayer, protective layer, filter layer without adding them to the emulsions.

Dyes may be incorporated in the photographic material of the present invention to improve safety against safelight. Preferred examples of the dyes are described in JP-A-52-20822, JP-A-59-154439 and JP-A-59-208548.

The photographic emulsion layers and other hydrophilic colloid layers of the photographic material of the present invention may contain matting agents such as silica, magnesium oxide and polymethyl methacrylate to prevent sticking.

The photographic emulsions of the present invention may contain a dispersion of a water-insoluble or difficultly soluble synthetic polymer to improve dimensional stability. For example, alkyl (meth)acrylates, alkoxyalkyl (meth)acrylates, (meth)acrylamide, vinyl esters (e.g., vinyl acetate) and acrylonitrile singly or in a combination can be used.

Gelatin is mainly used as the protective colloid for the emulsions of the present invention. Particularly, inert gelatin is advantageously used. Photographically inert gelatin derivatives (e.g., phthalated gelatin) and water-soluble synthetic polymers such as polyvinyl acrylate, polyvinyl alcohol and polyvinyl pyrrolidone may be used in place of gelatin.

The novel emulsions of the present invention are coated on an appropriate photographic support such as glass or a film base such as cellulose acetate, cellulose acetate butyrate or a polyester (e.g., polyethylene terephthalate).

Developing solutions containing sulfite ion at a low concentration, that is, lith type developing solutions can be used in the present invention. Further, developing solutions containing a sufficient amount of sulfite ion (particularly at least 0.15 mol/l) as a preservative can also be used in the present invention. In addition, developing solutions having a pH of not lower than 9.5, particularly 10.5 to 12.3 can be used.

There is no particular limitation with regard to developing agents which have used in the present invention. For example, dihydroxybenzenes (e.g., hydroquinone), 3-pyrazolidones (e.g., 1-phenyl-3-pyrazolidone, 4,5-dimethyl-1-phenyl-3-pyrazolidone) and aminophenols (e.g., N-methyl-p-aminophenol) can be used singly or in combination.

The developing solutions of the present invention may contain pH buffering agents such as alkali metal sulfites, carbonates, borates and phosphates, restrainers such as bromides, iodides and organic anti-fogging agents (preferably, nitroindazoles and benztriazoles) and other anti-fogging agents. If desired, the developing solutions may contain a water softener, a dissolution aid, a color toning agent, a development accelerator, a surfactant (particularly preferably the aforesaid polyalkylene oxides), an anti-foaming agent, a hardening agent and a silver stain inhibitor (e.g., 2-mercaptobenzimidazole sulfonic acids).

Examples of these additives are described in *Research Disclosure*, No. 176 (RD-17643).

Processing temperature is generally from 18° to 50° C. However, a temperature lower than 18° C. or higher than 50° C. may be used.

Fixing solutions having conventional compositions can be used. Examples of fixing agents include thiosulfates and thiocyanates. In addition thereto, known organosulfur compounds which have an effect as fixing agents can be used. The fixing solutions may contain water-soluble aluminum salts as hardening agents.

The direct positive type silver halide photographic materials have various uses. For example, they can be used as (1) various printing photographic materials for duplicating, reproduction and offset master, (2) as special photographic materials for X-ray photographic materials, flash photographs and electron beam photographs and (3) as various direct positive type photographic materials for general duplication, microcopies, direct positive type color, quick stabilized, diffusion transfer color diffusion transfer and monobath fixer.

The present invention is now illustrated in greater detail by reference to the following examples which, however, are not to be construed as limiting the invention in any way.

EXAMPLE 1

An Emulsion 1 was prepared in the following manner.

0.83 g of KBr and 31.3 g of gelatin were added to 1 liter of water and completely dissolved therein. While stirring the resulting solution, 957 cc of a 16.2% aqueous solution of potassium bromide and an aqueous solution of silver nitrate at a given flow rate were added thereto over a period of 81 minutes by a double jet process. The amount of silver nitrate added was 217 g. The temperature was kept at 70° C. during mixing. After soluble salts were removed from the resulting emulsion by a conventional precipitation method, gelatin was added thereto. The pH of the emulsion was adjusted to 7.0. Silver nitrate, gold chloride salt and aminoiminomethanesulfinic acid were added thereto with stirring at 60° C. Fogging was caused until the maximum performance was obtained by keeping the mixture with stirring at 65° C. for 70 minutes. At this time, the pH of the emulsion was re-adjusted to 6.0 and 2-[1,3-dinitrophenylthio]-5-sulfonyl-benzimidazole was added thereto. Thereafter, the temperature was lowered. The thus-prepared emulsion had a mean grain size of 0.26 μm and a gelatin concentration of 5.99 wt %.

Emulsions 2, 3 and 4 were prepared in the same way as in the preparation of the Emulsion 1 except that the Compound (i) in an amount of $5.0\times10^{-5}$ mol/mol of Ag, $5.0\times10^{-4}$ mol/mol of Ag and $1.0\times10^{-3}$ mol/mol of Ag, respectively, was added before the temperature was lowered but after the addition of 2-[1,3-dinitrophenylthio]-5-sulfonyl-benzimidazole.

An Emulsion 5 was prepared in the same way as in the preparation of the emulsion 1 except that the Compound (i) in an amount of $5.0\times10^{-4}$ mol/mol of Ag was added 20 minutes after the addition of aminoiminomethanesulfinic acid.

Emulsions 6 and 7 were prepared in the same way as in the preparation of Emulsion 1 except that the pH of the emulsion was re-adjusted to 5.5 and 6.5 instead of to 6.0.

Emulsions 8 and 9 were prepared in the same way as in the preparation of each of the Emulsions 6 and 7 except that the Compound (i) in an amount of $5.0\times10^{-4}$ mol/mol of Ag was added before the temperature was lowered but after the addition of 2-[1,3-dinitrophenylthio]-5-sulfonyl-benzimidazole.

Emulsions 11, 12 and 13 were prepared in the same way as in the preparation of the Emulsion 3 except that each of the Compounds (ii), (vi) and (viii) respectively was added in place of the Compound (i).

Within 30 minutes after the preparation of each of the Emulsions 1 to 9 and 11 to 13, pyrazolo(1,5a-benzimidazole) desensitizing dye, 2-[1,3 dinitrophenylthio]-5-chlorobenzimidazole, polyethylene glycol and 1,3-vinylsulfone-2-propanol were added to each emulsion at 40° C. within 30 minutes. Each of the resulting emulsions was coated in such an amount as to give a coating weight of 3.0 g/m² in terms of silver. A protective layer in a gelatin coating weight of 1.5 g/m² was provided. Dyes represented by the following Compounds A, B and C were incorporated in to the protective layer. Further, a back layer (in a gelatin coating weight of 4.4 g/m²) containing an antihalation dye was provided. The thus-prepared samples were referred to as 1-1, 2-1, 3-1, 4-1, 5-1, 6-1, 7-1, 8-1, 9-1, 11-1, 12-1 and 13-1, respectively.

A Sample 10-1 was prepared in the same way as in the preparation of the Sample 1-1 except that the Compound (i) in an amount of $5\times10^{-4}$ mol/mol of Ag was added after the addition of the reagents.

Compound A

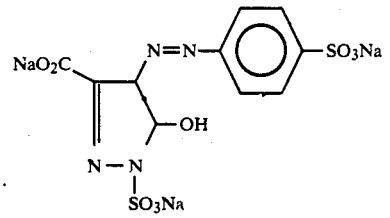

Compound B

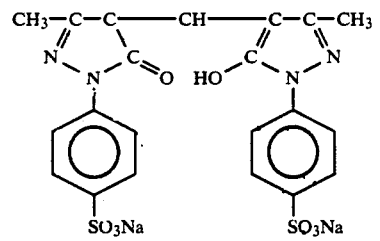

Compound C

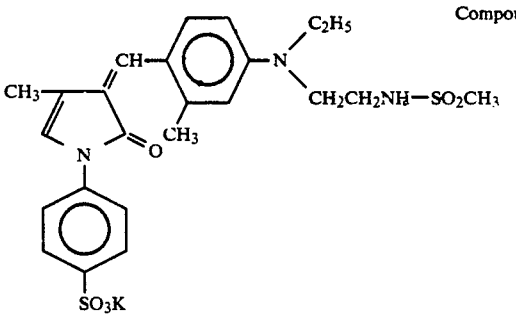

In Samples 1-1 and 2-1 to 13-1 the reagents were added to each emulsion within 30 minutes after the preparation of each emulsion and the resulting emulsion was coated. Samples 1-2, 2-2, 3-2, 4-2, 5-2, 6-2, 7-2, 8-2, 9-2, 10-2, 11-2, 12-2 and 13-2 were prepared in the same way as in the preparation of 1-1, 2-1, 3-1, 4-1, 5-1, 6-1, 7-1, 8-1, 9-1, 10-1, 11-1, 12-1 and 13-1 except that each emulsion was stored at 8° C. for 10 days after the preparation thereof, the temperature was raised to 40° C., the reagents were added thereto and the resulting emulsion was coated.

Three days after coating, these samples were exposed to tungsten light source (color temperature 2864K.) through wedge, developed with a developing solution having the following formulation at 38° C. for 20 seconds, washed with water and dried. The reciprocal of the exposure amount giving a density of 1.5 was referred to herein as sensitivity. The sensitivity was represented by relative sensitivity when the sensitivity of the Sample 1-1 was referred to as 100. Further, relative sensitivity was determined in the manner described above after these samples were left to stand in air for 3 months. The results are shown in Table 1.

| | |
|---|---|
| Phenidone | 0.8 g |
| Hydroquinone | 25 g |
| Potassium bromide | 3.3 g |
| Sodium carbonate | 10.8 g |
| Sodium sulfite | 67 g |
| 5-Methylbenztriazole | 0.2 g |
| Ethylenediaminetetraacetic acid | 2.8 g |
| Sodium 2-mercaptobenzimidazole-5-sulfonate | 0.3 g |
| Add KOH and $H_2O$ | to make 1 liter |

-continued (pH = 10.7)

It is clear that the pairs of samples [2), (3), (4), (5), (11), (12) and (13) according to the present invention cause less of a degree of sensitization when the direct reversal emulsions are stored at 8° C. for 10 days after

TABLE 1

| Sample No. | Direct Reversal Emulsion | Compound Added: Compound No. | Compound Added: Amount Added (mol/mol Ag) | Compound Added: Addition Stage | pH of Emulsion after Readjustment | Time Elapsed before Coating, after Preparation of Emulsion | Relative Sensitivity: 3 Days after Coating | Relative Sensitivity: 3 Months after Coating | Ratio of Relative Sensitivity: 10 days at 8° C. after Preparation of Emulsion/within 30 min after Preparation of Emulsion | Ratio of Relative Sensitivity: 3 Months after Coating/3 Days after Coating | |
|---|---|---|---|---|---|---|---|---|---|---|---|
| (1) | | | | | | | | | | | |
| 1-1 | Emulsion 1 | — | 0 | — | 6.0 | within 30 | 100 | 130 | 1.25 | 1.30 | Com- |
| 1-2 | " | — | 0 | — | " | min 10 day (at 8° C.) | 125 | 153 | | 1.22 | parison |
| (2) | | | | | | | | | | | |
| 2-1 | Emulsion 2 | (i) | $5 \times 10^{-5}$ | at the | 6.0 | within 30 | 102 | 108 | 1.05 | 1.06 | Invention |
| 2-2 | " | " | " | time of completion of fogging | " | min 10 days (at 8° C.) | 107 | 111 | | 1.04 | |
| (3) | | | | | | | | | | | |
| 3-1 | Emulsion 3 | (i) | $5 \times 10^{-4}$ | at the | 6.0 | within 30 | 101 | 102 | 1.01 | 1.01 | " |
| 3-2 | " | (i) | " | time of completion of fogging | " | min 10 days (at 8° C.) | 102 | 103 | | 1.01 | |
| (4) | | | | | | | | | | | |
| 4-1 | Emulsion 4 | (i) | $1 \times 10^{-3}$ | at the | 6.0 | within 30 | 99 | 100 | 1.01 | 1.01 | " |
| 4-2 | " | (i) | " | time of completion of fogging | | min 10 days (at 8° C.) | 100 | 100 | | 1.00 | |
| (5) | | | | | | | | | | | |
| 5-1 | Emulsion 5 | (i) | $1 \times 10^{-3}$ | during | 6.0 | within 30 | 83 | 85 | 1.02 | 1.02 | Invention |
| 5-2 | " | (i) | " | fogging stage | " | min 10 days (at 8° C.) | 85 | 87 | | 1.02 | |
| (6) | | | | | | | | | | | |
| 6-1 | Emulsion 6 | — | 0 | — | 5.5 | within 30 | 88 | 119 | 1.29 | 1.35 | Com- |
| 6-2 | " | — | 0 | — | " | min 10 days (at 8° C.) | 114 | 150 | | 1.32 | parison |
| (7) | | | | | | | | | | | |
| 7-1 | Emulsion 7 | — | 0 | — | 6.5 | within 30 | 108 | 135 | 1.20 | 1.25 | Com- |
| 7-2 | " | — | 0 | — | " | min 10 days (at 8° C.) | 130 | 156 | | 1.20 | parison |
| (8) | | | | | | | | | | | |
| 8-1 | Emulsion 8 | (i) | $5 \times 10^{-4}$ | at the | 5.5 | within 30 | 89 | 96 | 1.07 | 1.08 | Invention |
| 8-2 | " | (i) | " | time of completion of fogging | " | min 10 days (at 8° C.) | 95 | 101 | | 1.06 | |
| (9) | | | | | | | | | | | |
| 9-1 | Emulsion 9 | (i) | $5 \times 10^{-4}$ | at the | 6.5 | within 30 | 110 | 111 | 1.01 | 1.01 | Invention |
| 9-2 | " | (i) | " | time of completion of fogging | " | min 10 days (at 8° C.) | 111 | 111 | | 1.00 | |
| (10) | | | | | | | | | | | |
| 10-1 | Emulsion 10 | (i) | $5 \times 10^{-4}$ | just before | 6.0 | within 30 | 100 | 106 | 1.23 | 1.06 | " |
| 10-2 | " | (i) | " | coating | " | min 10 days (at 8° C.) | 123 | 129 | | 1.05 | |
| (11) | | | | | | | | | | | |
| 11-1 | Emulsion 11 | (ii) | $5 \times 10^{-4}$ | at the | 6.0 | within 30 | 102 | 109 | 1.05 | 1.07 | " |
| 11-2 | " | (ii) | " | time of completion of fogging | " | min 10 days (at 8° C.) | 107 | 112 | | 1.05 | |
| (12) | | | | | | | | | | | |
| 12-1 | Emulsion 12 | (vi) | $5 \times 10^{-4}$ | at the | 6.0 | within 30 | 103 | 110 | 1.05 | 1.07 | " |
| 12-2 | " | (vi) | " | time of completion of fogging | " | min 10 days (at 8° C.) | 108 | 114 | | 1.06 | |
| (13) | | | | | | | | | | | |
| 13-1 | Emulsion 13 | (viii) | $5 \times 10^{-4}$ | at the | 6.0 | within 30 | 98 | 105 | 1.05 | 1.07 | Invention |
| 13-2 | " | (viii) | " | time of completion of fogging | " | min 10 days (at 8° C.) | 103 | 110 | | 1.05 | |

the preparation thereof and the coated samples are left to stand in air for 3 months in comparison with a pair of Comparative Sample (1).

It is also clear that the pairs of Samples (8) and (9) according to the present invention cause less of a degree of sensitization when the direct reversal emulsions are stored at 8° C. for 10 days after the preparation thereof and the coated samples are left to stand in air for 3 months in comparison with pairs of Comparative Samples (6) and (7).

Further, it is clear that the pair of Samples (10) according to the present invention causes less of a degree of sensitization when the coated samples are left to stand in air for 3 months than the pair of Comparative Samples (1). It is also clear that even when the Compound (i) is added just before coating, the coated samples are stable even after the lapse of time.

EXAMPLE 2

Both of Emulsions 14 and 15 were prepared in the same way as in the preparation of both of the Emulsions 1 and 3 of Example 1 except that the halogen composition was AgClBr (Cl: 99 mol %).

Samples 14-1, 14-2, 15-1 and 15-2 were prepared in the same way as in the preparation of the Samples 3-1 and 3-2 of Example 1 except that Emulsions 14 and 15 were used.

The relative sensitivity of these samples was determined in the same way as in Example 1. The sensitivity of the Sample 13-1 was referred to as 100. The results are shown in Table 2.

samples are left to stand in air for 3 months than the pair of comparative samples (14).

EXAMPLE 3

Emulsions 16 and 17 were prepared in the same way as in the preparation of Emulsion 1 of Example 1 except that a water-soluble rhodium salt in an amount of $5.5\times10^{-5}$ mol/mol of Ag and $5.5\times10^{-4}$ mol/mol of Ag, respectively, was added to an aqueous solution of potassium bromide used in the preparation of the Emulsion 1.

Emulsions 18 and 19 were prepared in the same way as in the preparation of the Emulsion 3 of Example 1 except that a water-soluble rhodium salt in an amount of $5.5\times10^{-5}$ mol/mol of Ag and $5.5\times10^{-4}$ mol/mol of Ag was added to the aqueous solution of potassium bromide used in the preparation of the Emulsion 3.

Samples 1-1, 1-2, 16-1, 16-2, 17-1, 17-2, 3-1, 3-2, 18-1, 18-2, 19-1 and 19-2 were prepared in the same way as in the preparation of the Samples 3-1 and 3-2 of Example 1 except that each of Emulsions 1, 16, 17, 3, 18 and 19 was used.

These samples in an unexposed state were developed with the developing solution of Example 1 at 38° C. for 20 seconds, and the density of each sample was measured.

These samples were than exposed to tungsten light source (color temperature 2864K.) for (357) lux (100 seconds. The density of each sample was measured in the same manner as in the measurement of the above unexposed samples.

TABLE 2

| Sample No. | Direct Reversal Emulsion | Compound Added: Compound No. | Compound Added: Amount Added (mol/mol Ag) | Compound Added: Addition Stage | pH of Emulsion after Readjustment | Time Elapsed before Coating, after Preparation of Emulsion | Relative Sensitivity: 3 Days after Coating | Relative Sensitivity: 3 Months after Coating | Ratio of Relative Sensitivity: 10 days at 8° C. after Preparation of Emulsion/within 30 min after Preparation of Emulsion | Ratio of Relative Sensitivity: 3 Months after Coating/3 Days after Coating | |
|---|---|---|---|---|---|---|---|---|---|---|---|
| (14) | | | | | | | | | | | |
| 14-1 | 14 | — | 0 | — | 6.0 | within 30 min | 100 | 120 | 1.30 | 1.20 | Comp. |
| 14-2 | " | — | 0 | — | | 10 days (at 8° C.) | 130 | 153 | | 1.18 | Ex. |
| (15) | | | | | | | | | | | |
| 15-1 | 15 | (i) | $5\times10^{-4}$ | at the time of completion of fogging | 6.0 | within 30 min | 101 | 106 | 1.07 | 1.05 | Invention |
| 15-2 | " | (i) | | | | 10 days (at 8° C.) | 108 | 112 | | 1.03 | |

It is clear that the pair of samples (15) according to the present invention cause less of a degree of sensitization when the direct reversal emulsion is stored at 8° C. for 10 days after the preparation thereof and the coated Relative sensitivity was determined in the same manner as in Example 1 when the sensitivity of Sample 1-1 was referred to as 100. The results are shown in Table 3.

TABLE 3

| Sample No. | Direct Positive Emulsion | Water-Soluble Rh Salt (mol/mol Ag) | Compound Added: Compound No. | Compound Added: Amount Added (mol/mol Ag) | Compound Added: Addition Stage | pH of Emulsion after Readjustment | Time Elapsed until Coating after Preparation of Emulsion |
|---|---|---|---|---|---|---|---|
| Comparison | | | | | | | |
| 1-1 | Emulsion 1 | — | — | 0 | — | 6.0 | within 30 min |
| 1-2 | " | — | — | 0 | — | " | 10 days (at 8° C.) |
| 16-1 | Emulsion 16 | $5.5\times10^{-5}$ | — | 0 | — | 6.0 | within 30 min |
| 16-2 | " | " | — | 0 | — | " | 10 days (at 8° C.) |

TABLE 3-continued

| | | | | | | | |
|---|---|---|---|---|---|---|---|
| 17-1 | Emulsion 17 | $5.5 \times 10^{-4}$ | — | 0 | — | 6.0 | within 30 min |
| 17-2 | " | " | — | 0 | — | " | 10 days (at 8° C.) |
| Invention | | | | | | | |
| 3-1 | Emulsion 3 | — | (i) | $5 \times 10^{-4}$ | at the time of completion of fogging | 6.0 | within 30 min |
| 3-2 | " | — | (i) | " | | " | 10 days (at 8° C.) |
| 18-1 | Emulsion 18 | $5.5 \times 10^{-5}$ | (i) | $5 \times 10^{-4}$ | at the time of completion of fogging | 6.0 | within 30 min |
| 18-2 | " | " | (i) | " | | " | 10 days (at 8° C.) |
| 19-1 | Emulsion 19 | $5.5 \times 10^{-4}$ | (i) | $5 \times 10^{-4}$ | at the time of completion of fogging | 6.0 | within 30 min |
| 19-2 | " | " | (i) | " | | " | 10 days (at 8° C.) |

| Sample No. | Unexposed Sample (3 Days after Coating) | After Exposure | Relative Sensitivity: 3 Days after Coating | Relative Sensitivity: 3 Months after Coating | Ratio of Relative Sensitivity: 10 Days at 8° C. after Preparation of Emulsion/ within 3 Min after Preparation of Emulsion | Ratio of Relative Sensitivity: 3 Months after Coating/ 3 Days after Coating |
|---|---|---|---|---|---|---|
| Comparison | | | | | | |
| 1-1 | 4.50 | 0.05 | 100 | 130 | 1.25 | 1.30 |
| 1-2 | 4.45 | 0.05 | 125 | 153 | | 1.22 |
| 16-1 | 4.42 | 1.49 | 20.0 | 25.6 | 1.20 | 1.28 |
| 16-2 | 4.36 | 1.20 | 24.0 | 29.0 | | 1.21 |
| 17-1 | 4.38 | 4.38 | 2.0 | 2.5 | 1.20 | 1.26 |
| 17-2 | 4.31 | 4.33 | 2.4 | 2.9 | | 1.20 |
| Invention | | | | | | |
| 3-1 | 4.51 | 0.05 | 101 | 102 | 1.01 | 1.01 |
| 3-2 | 4.47 | 0.05 | 102 | 103 | | 1.01 |
| 18-1 | 4.43 | 1.53 | 19.0 | 20.7 | 1.08 | 1.09 |
| 18-2 | 4.36 | 1.48 | 20.5 | 21.5 | | 1.05 |
| 19-1 | 4.39 | 4.39 | 2.1 | 2.4 | 1.10 | 1.15 |
| 19-2 | 4.33 | 4.32 | 2.3 | 2.6 | | 1.13 |

It is apparent that when the pairs of Samples (3), (18) and (19) are compared with one another, high-sensitivity samples (3) cause a less degree of sensitization when the emulsion is stored at 8° C. for 10 days after the preparation thereof and the coated sample is left to stand in air for 3 months in comparison with the Samples (18) and (19).

It will be understood that the effect of the present invention is greater, the higher the sensitivity of the direct reversal emulsion used.

EXAMPLE 4

An emulsion 1' was prepared in the following manner.

A solution of 0.15 mol of potassium bromide and 0.5 mol of sodium chloride containing 30 mg of rhodium chloride and a solution of 0.6 mol of silver nitrate were added to 1 liter of a 2.5% gelatin solution at 40° C. over a period of about 20 minutes to form silver chlorobromide. The pH of the mixture was raised to 9.8 by sodium carbonate and formaldehyde added thereto. The mixture was heated for about 70 minutes to effect fogging. Subsequently, the resulting emulsion was washed with water and desalted by a conventional flocculaion method. Gelatin was then added thereto and the mixture was dispersed and dissolved at 40° C. over a period of 30 minutes, and the temperature of the emulsion was lowered (Emulsion 1').

Emulsions 2', 3' and 4' were prepared in the same way as in the preparation of Emulsion 1' except that the Compound-(xv) of formula (3) according to the present invention was added in an amount of $2\times10^{-6}$ mol/mol of Ag, $2\times10^{-2}$ mol/mol of Ag and $2\times10^{-1}$ mol/mol of Ag before the temperature was lowered.

Emulsions 5' and 6' were prepared in the same way as in the preparation of Emulsion 1' except that the Compound-(xix) and (xxix) of formula (3) according to the present invention were respectively added in an amount of $2\times10^{-2}$ mol/mol of Ag before the temperature was lowered.

Emulsions 7' and 8' were prepared in the same way as in the preparation of Emulsion 1' except that Comparative Compound-1' and Comparative Compound-2' in an amount of $2\times10^{-2}$ mol/mol of Ag was added before the temperature was lowered.

Within one day after the preparation of each of the thus-prepared Emulsions 1' to 8', 6-ethoxy-1-methyl-2-(3-nitrostyryl)-quinolium nitrilesulfate as the desensitizing dye, a stabilizer, a coating agent and a hardening agent were added to each emulsion and the resulting emulsion was coated in such an amount as to give a coating weight of 2.5 g/m$^2$ in terms of Ag. A protective layer in a gelatin coating weight of 1.2 g/m$^2$ was provided. The thus-prepared samples were referred to as 1'-1, 2'-1, 3'-1, 4'-1, 5'-1, 6'-1, 7'-1 and 8'-1, respectively.

A Sample 9'-1 was prepared in the same way as in the preparation of Sample 1'-1 except that the Compound-(xv) of formula (3) according to the present invention was added in an amount of $2\times10^{-2}$ mol/mol of Ag at 40° C. after the addition of the reagents.

Samples 1'-2, 2'-2, 3'-2, 4'-2, 5'-2, 6'-2, 7'-2 and 8'-2 were prepared in the same way as in the preparation of Samples 1'-1, 2'-1, 3'-1, 4'-1, 5'-1, 6'-1, 7'-1 and 8'-1 except that each of the Emulsions 1' to 8' was stored at 5° C. for 10 days, the temperature was raised to 40° C. and 6-ethoxy-1-methyl-2-(3-nitrostyryl)-quinolium nitrilesulfate as desensitizing dye, a stabilizer, a coating agent and a hardening agent were then added to each emulsion.

These samples were exposed to a mercury light source through wedge, developed with Papitol developing solution (manufactured by Fuji Photo Film Co., Ltd.), stopped, fixed, washed with water and dried.

The reciprocal of the exposure amount giving a density of 1.0 was referred to as sensitivity. The sensitivity of each sample was represented by relative sensitivity when the sensitivity of the sample 1'-1 was referred to as 100. The results are shown in Table 4.

C. for 10 days after the preparation thereof than Comparative Samples 1'-2, 7'-2 and 8'-2.

According to the present invention, there can be provided a direct positive type silver halide photographic material which cause a less change in sensitivity after coating and a process for producing emulsions which scarcely cause a change in sensitivity even when

TABLE 4

| Sample No. | Compound of Formula (3) | Amount Added | Addition Stage | Time Elapsed before Coating, after Preparation | Relative Sensitivity (A) 1 Day after Coating | Relative Sensitivity (B) 120 Days after Coating | Rate of Change (B)/(A) × 100 | |
|---|---|---|---|---|---|---|---|---|
| 1'-1 | — | — | — | 1 day | 100 | 130 | 130 | Comparison |
| 2'-1 | Compound-(xv) | $2 \times 10^{-6}$ | at the time of completion of fogging | " | 100 | 110 | 110 | Invention |
| 3'-1 | " | $2 \times 10^{-2}$ | at the time of completion of fogging | " | 101 | 108 | 107 | " |
| 4'-1 | " | $2 \times 10^{-1}$ | at the time of completion of fogging | " | 102 | 108 | 106 | " |
| 5'-1 | Compound-(xix) | $2 \times 10^{-2}$ | at the time of completion of fogging | " | 101 | 112 | 111 | " |
| 6'-1 | Compound-(xxix) | " | at the time of completion of fogging | " | 101 | 115 | 114 | " |
| 7'-1 | Comparative Compound-1 | " | at the time of completion of fogging | " | 95 | 145 | 153 | Comparison |
| 8'-1 | Comparative Compound-2 | " | at the time of completion of fogging | " | 102 | 125 | 123 | " |
| 9'-1 | Compound-(xv) | " | just before coating | " | 101 | 110 | 109 | Invention |
| 1'-2 | — | — | — | 10 days | 110 | — | 110 | Comparison |
| 2'-2 | Compound-(xv) | $2 \times 10^{-6}$ | at the time of completion of fogging | " | 105 | — | 105 | Invention |
| 3'-2 | " | $2 \times 10^{-2}$ | at the time of completion of fogging | " | 104 | — | 103 | " |
| 4'-2 | " | $2 \times 10^{-1}$ | at the time of completion of fogging | " | 104 | — | 102 | " |
| 5'-2 | Compound-(xix) | $2 \times 10^{-2}$ | at the time of completion of fogging | " | 105 | — | 104 | " |
| 6'-2 | Compound-(xxix) | " | at the time of completion of fogging | " | 106 | — | 105 | " |
| 7'-2 | Comparative Compound-1 | " | at the time of completion of fogging | " | 130 | — | 137 | Comparison |
| 8'-2 | Comparative Compound-2 | " | at the time of completion of fogging | " | 110 | — | 109 | " |

Comparative Compound-1

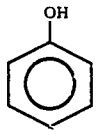

Comparative Compound-2

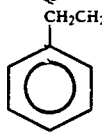

It is apparent that Samples 2'-1, 3'-1, 4'-1, 5'-1 and 6'-1 according to the present invention cause a less change in sensitivity when left to stand in air for 120 days after coating than do Comparative Samples 1'-1, 7'-1 and 8'-1. Further, it is clear from Sample 9'-1 that the Compound-(xv) of formula (3) has an effect of reducing a change in sensitivity on standing in air after coating even when added just before coating.

It is also clear that Samples 2'-2, 3'-2, 4'-2, 5'-2 and 6'-2 according to the present invention cause less change in sensitivity when the emulsions are stored at 5° stored until coating after the preparation thereof.

While the invention has been described in detail and with reference to specific embodiments thereof, it will be apparent to one skilled in the art that various changes and modifications can be made therein without departing from the spirit and scope thereof.

What is claimed is:

1. An autopositive silver halide photographic material which comprises at least one silver halide emulsion layer wherein said emulsion layer or at least one other hydrophilic colloid layer contains at least one member selected from the group consisting of the compounds represented by the following general formulas (1), (2) and (3):

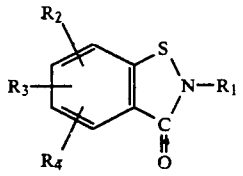

(1)

wherein $R_1$ represents hydrogen atom or an alkyl group; and $R_2$, $R_3$ and $R_4$ each represents hydrogen atom, a halogen atom, an alkyl group or an alkoxy group;

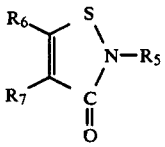

(2)

wherein $R_5$ represents hydrogen atom or an alkyl group; and $R_6$ and $R_7$ each represents hydrogen atom, an alkyl group, a halogen atom or an aryl group;

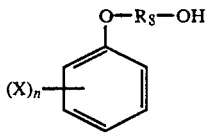

(3)

wherein $R_8$ represents a lower alkylene group; X represents a halogen atom, nitro group, hydroxy group, a cyano group, a lower alkyl group, a lower alkoxy group, $—COR_{12}$,

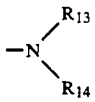

or $—SO_3M$; $R_{12}$ represents hydrogen atom, —OM, a lower alkyl group, a lower alkoxy group or

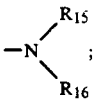

$R_{13}$ and $R_{14}$ may be the same or different groups and each represents hydrogen atom, a lower alkyl group, $—COR_{17}$ or $—SO_2R_{17}$; $R_{15}$ and $R_{16}$ may be the same or different groups and each represents hydrogen atom or a lower alkyl group; $R_{17}$ represents a lower alkyl group; M represents hydrogen atom, an alkali metal or an atomic group required for forming a monovalent cation; and n represents 0 or an integer of 1 to 5.

2. An autopositive silver halide photographic material as in claim 1, wherein said silver halide emulsion has (1) a density of at least 2.0 when a sample is prepared by coating the emulsion in such an amount as to give a coating weight of 3.0 g/m$^2$ in terms of silver and the sample in an unexposed state is developed under the following conditions and (2) a density of not higher than 1.8 when the sample is exposed to tungsten light source (color temperature 2864K.) for (357) lux (100) seconds and then developed under the following conditions:

(a) composition of developing solution:

| | |
|---|---|
| Phenidone | 0.8 g |
| Hydroquinone | 25 g |
| Potassium bromide | 3.3 g |
| Sodium carbonate | 10.8 g |
| Potassium sulfite | 67 g |
| 5-Methylbenztriazole | 0.2 g |
| Ethylenediaminetetraacetic acid | 2.8 g |
| Sodium 2-mercaptobenzimidazole-5-sulfonate | 0.3 g |
| Add KOH and $H_2O$ | to make 1 liter; and pH 10.7 |

(b) development temperature, 38° C.; and (c) development time, 20 seconds.

3. An autopositive silver halide photographic material of claim 1, wherein the compounds represented by the general formula (1) or (2) are used in an amount of $5\times10^{-6}$ to $5\times10^{-3}$ mol per mol of silver.

4. An autopositive silver halide photographic material of claim 1, wherein the compounds represented by the general formula (3) are used in an amount of $2\times10^{-6}$ to $2\times10^{-1}$ mol per mol of silver halide.

5. An autopositive silver halide photographic material of claim 1, wherein said silver halide emulsion is monodisperse.

6. An autopositive silver halide photographic material of claim 1, wherein said emulsion layer or at least one other hydrophilic colloid layer contains a compound represented by general formula (1).

7. An autopositive silver halide photographic material of claim 1, wherein said emulsion layer or at least one other hydrophilic colloid layer contains a compound represented by general formula (2).

8. An autopositive silver halide photographic material of claim 1, wherein said emulsion layer or at least one other hydrophilic colloid layer contains a compound represented by general formula (3).

* * * * *